US007675272B2

(12) United States Patent
Michallick et al.

(10) Patent No.: US 7,675,272 B2
(45) Date of Patent: Mar. 9, 2010

(54) OUTPUT IMPEDANCE COMPENSATION FOR LINEAR VOLTAGE REGULATORS

(75) Inventors: Ronald Andrew Michallick, McKinney, TX (US); Sean Michael Malolepszy, Sherman, TX (US); Rex Warren Pirkle, Denison, TX (US)

(73) Assignee: Texas Instruments Incoporated, Dallas, TX (US)

( * ) Notice: Subject to any disclaimer, the term of this patent is extended or adjusted under 35 U.S.C. 154(b) by 390 days.

(21) Appl. No.: 11/890,930

(22) Filed: Aug. 8, 2007

(65) Prior Publication Data

US 2009/0039847 A1 Feb. 12, 2009

(51) Int. Cl.
*G05F 1/40* (2006.01)

(52) U.S. Cl. ..... 323/266; 323/273

(58) Field of Classification Search ..... 323/266–277
See application file for complete search history.

(56) References Cited

U.S. PATENT DOCUMENTS 4,881,023 A * 11/1989 Perusse et al. ..... 323/266
5,850,139 A * 12/1998 Edwards ..... 323/280
5,852,359 A * 12/1998 Callahan et al. ..... 323/274
5,894,215 A 4/1999 Yazdy et al.
6,965,218 B2 11/2005 Scoones et al.
2005/0189930 A1 9/2005 Wu et al.
2006/0103361 A1 5/2006 Jiang et al.
2006/0108991 A1 5/2006 Jiang et al.

OTHER PUBLICATIONS

Product Specification Sheet entitled 'Low-Voltage Adjustable Precision Shunt Regulators', TLV431, TLV431A, Texas Instruments Incorporated, 19 pages, Jun. 2002.

* cited by examiner

*Primary Examiner*—Adolf Berhane
(74) *Attorney, Agent, or Firm*—William B. Kempler; Wade J. Brady III; Frederick J. Telecky, Jr.

(57) ABSTRACT

In a method and system for regulating an output voltage, a linear voltage regulator (LVR) includes an adjustable shunt regulator (ASR) having a limited gain, a feedback circuit (FC), and a compensation resistor (CR). The limited gain causes the output voltage of the ASR to change in response to a change in an input current of the ASR. The FC generates a feedback voltage reference in proportion to the output voltage, the feedback voltage reference being provided to the ASR to control the output voltage. The CR is coupled to the ASR and the FC. The input current flows through the CR to provide a compensating voltage across the CR. The compensating voltage is provided to the feedback circuit to compensate the limited gain, thereby providing the output voltage that is substantially independent of the input current.

20 Claims, 2 Drawing Sheets

OUTPUT IMPEDANCE COMPENSATION FOR LINEAR VOLTAGE REGULATORS

BACKGROUND

The present disclosure relates generally to integrated circuits, and more particularly to an apparatus and method for improving accuracy of a linear voltage regulator (LVR).

An adjustable shunt regulator (ASR) is a well known integrated circuit (IC) chip that provides a regulated output voltage that is used as a highly accurate, programmable reference source. The ASR is often included in the design of a power supply system. A linearly acting semiconductor device such as a linear voltage regulator (LVR), operating in shunt with a source or load, is also used as a basic building block of a power supply that provides power to electronic devices. The output voltage of the LVR is linearly adjustable between a minimum voltage level, e.g., 2.5 volts, and a maximum voltage level, e.g., 36 volts, by selecting appropriate values of external resistors used in conjunction with the ASR. The ASR typically provides specified accuracy over a specified operating temperature range. Examples of commercially available ASR products include low-voltage adjustable precision shunt regulators TLV1431 and TLV431A manufactured by Texas Instruments Incorporated, Dallas, Tex.

Accuracy of the output voltage provided by the ASR is typically valid at a fixed value of a cathode current, as stated in the ASR product specification data sheet. However, the accuracy often deteriorates rapidly as the cathode current deviates from the fixed value. Therefore, a need exists to provide a method and apparatus for providing a regulated, linear voltage output having an improved accuracy.

SUMMARY

Applicants recognize that the ability of the ASR to maintain an accurate output voltage over varying cathode currents is specified by an output impedance (also referred to as dynamic impedance or simply Zka) value of the ASR. Zka, measured in ohms, is defined as a ratio of a change in output voltage divided by a corresponding change in cathode current. Applicants further recognize that the ASR is a limited gain device. That is, gain settings for operational amplifiers included in the ASR are typically between a minimum and a maximum value, and are therefore limited. The limited gain of the ASR causes the ASR to have an effective Zka, thereby causing the output voltage to change with the cathode current. Therefore, due to the effects of Zka the accuracy of the output voltage degrades with the changes in the cathode current. It would be desirable to compensate for the limited gain of the ASR and provide an accurate output voltage that is substantially independent of the cathode current. Accordingly, it would be desirable to provide a method and system for improving accuracy of a linear voltage regulator (LVR), absent the disadvantages found in the prior methods discussed above.

The foregoing needs are addressed by the teachings of the present disclosure, which relates to an apparatus and method for regulating a linear output voltage. According to one embodiment, in a method and system for regulating an output voltage, a linear voltage regulator (LVR) includes an adjustable shunt regulator (ASR) having a limited gain, a feedback circuit (FC), and a compensation resistor (CR). The limited gain causes the output voltage of the ASR to change in response to a change in an input current of the ASR. The FC generates a feedback voltage reference in proportion to the output voltage, the feedback voltage reference being provided to the ASR to control the output voltage. The CR is coupled to the ASR and the FC. The input current flows through the CR to provide a compensating voltage across the CR. The compensating voltage is provided to the feedback circuit to compensate the limited gain, thereby providing the output voltage that is independent of the input current.

In one aspect of the disclosure, a method for regulating an output voltage of an adjustable shunt regulator (ASR) includes configuring the output voltage of the ASR having a limited gain, the limited gain causing the output voltage to change in response to a corresponding change in an input current of the ASR. A feedback circuit is configured to generate a feedback voltage reference in proportion to the output voltage, the feedback voltage reference being provided to the ASR to control the output voltage. A compensation resistor is disposed to carry the input current, thereby generating a compensating voltage across the compensation resistor. The compensating voltage is added to the feedback voltage reference. The addition of the compensating voltage provides compensation for the limited gain, thereby providing the output voltage that is substantially independent of the input current.

Several advantages are achieved by the method and system according to the illustrative embodiments presented herein. The embodiments advantageously provide for an accurate, linear voltage regulator (LVR) that provides an output voltage that is substantially independent of the cathode current. The LVR is based on a commercially available adjustable shunt regulator (ASR). The accuracy of the output voltage of the LVR is maintained throughout the operating range of the cathode current. A compensation resistor is advantageously added to carry the cathode current, thereby generating a compensating voltage. The compensating voltage is added to the feedback circuit of the ASR to compensate for the limited gain. With the compensating voltage, the effective Zka of the ASR is advantageously reduced by a factor of at least 10, thereby providing an output voltage that is substantially independent of the cathode current. The compensation resistor is easily fabricated as a metal trace and integrated with the ASR.

DETAILED DESCRIPTION

Figure 1:
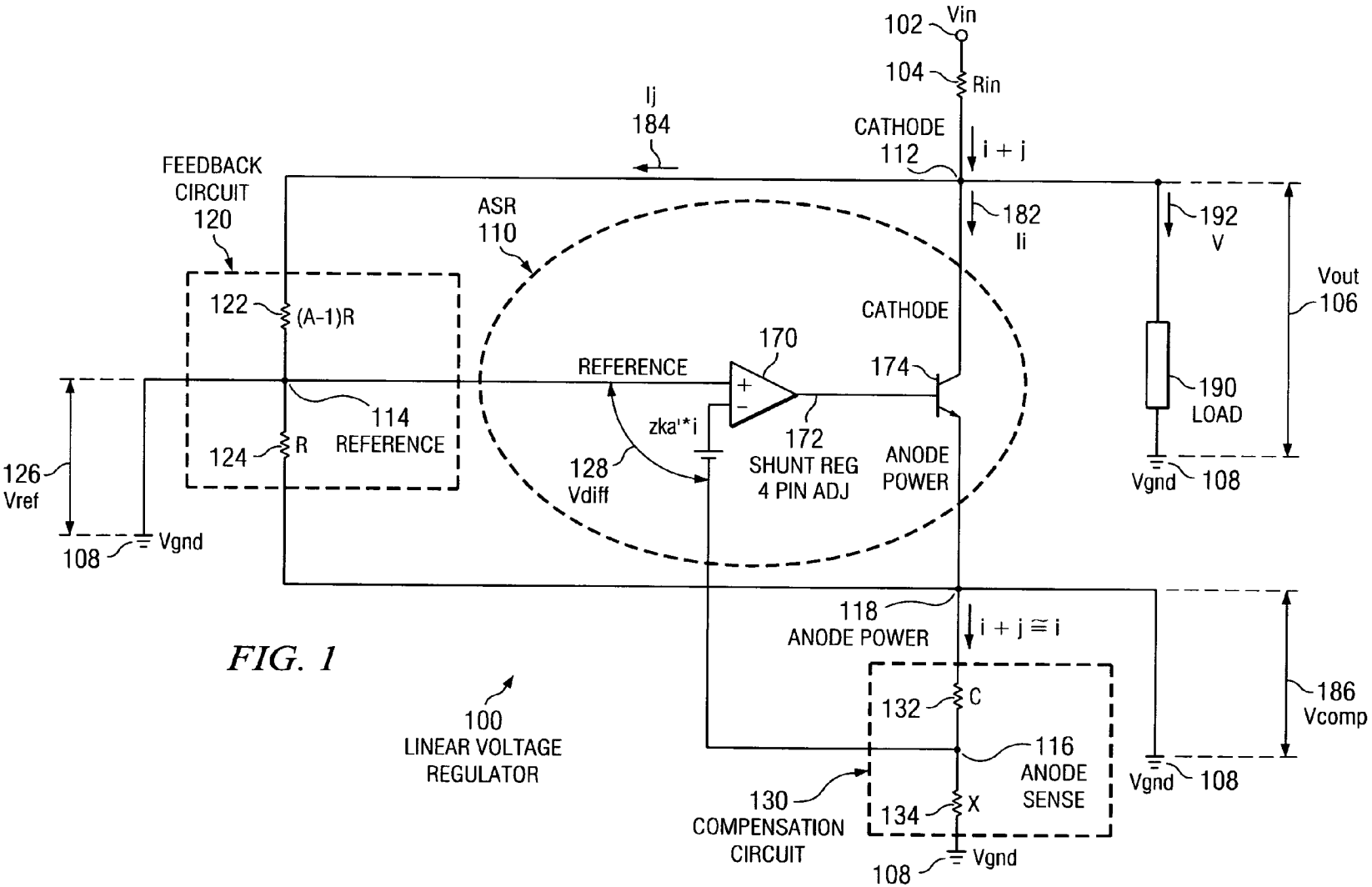
FIG. 1 illustrates a block diagram of a linear voltage regulator (LVR), according to an embodiment.

Novel features believed characteristic of the present disclosure are set forth in the appended claims. The disclosure itself, however, as well as a preferred mode of use, various objectives and advantages thereof, will best be understood by reference to the following detailed description of an illustrative embodiment when read in conjunction with the accompanying drawings. The functionality of various circuits, devices or components described herein may be implemented as hardware (including discrete components, integrated circuits and systems-on-a-chip 'SoC'), firmware (including application specific integrated circuits and programmable chips) and/or software or a combination thereof, depending on the application requirements.

Similarly, the functionality of various mechanical elements, members, or components for forming modules, subassemblies and assemblies assembled in accordance with a structure for an apparatus may be implemented using various materials and coupling techniques, depending on the application requirements. Descriptive and directional terms used in the written description such as top, bottom, left, right, and similar others, refer to the drawings themselves as laid out on the paper and not to physical limitations of the disclosure unless specifically noted. The accompanying drawings may not to be drawn to scale and some features of embodiments shown and described herein may be simplified or exaggerated for illustrating the principles, features, and advantages of the disclosure.

Accuracy of an output voltage of the ASR is typically valid at a fixed value of a cathode current, as stated in the ASR product specification data sheet. However, the accuracy often deteriorates rapidly as the cathode current deviates from the fixed value. Therefore, a need exists to provide a method and system for providing a regulated, linear voltage output having an improved accuracy. This problem may be addressed by an improved apparatus and method for regulating a voltage output.

According to one embodiment, in a method and apparatus for regulating an output voltage, a linear voltage regulator (LVR) includes an adjustable shunt regulator (ASR) having a limited gain, a feedback circuit (FC), and a compensation resistor (CR). The limited gain causes the output voltage of the ASR to change in response to a change in an input current of the ASR. The FC generates a feedback voltage reference in proportion to the output voltage, the feedback voltage reference being provided to the ASR to control the output voltage. The CR is coupled to the ASR and the FC. The input current flows through the CR to provide a compensating voltage across the CR. The compensating voltage is provided to the feedback circuit to compensate the limited gain, thereby providing the output voltage that is substantially independent of the input current.

The following terminology may be useful in understanding the present disclosure. It is to be understood that the terminology described herein is for the purpose of description and should not be regarded as limiting.

Linear voltage regulator (LVR)—A LVR provides a constant direct current (DC) output voltage that is independent of the changes in load current or input voltage, provided the LVR is operated within its specified operating range. The LVR uses a voltage-controlled current source (VCIS) to provide a fixed output voltage at an output terminal. The LVR includes feedback control circuitry to monitor (or sense) the output voltage, and adjust the current source (as required by the load) to hold the output voltage at the desired constant value.

Semiconductor Device—A semiconductor device is an electronic component that utilizes electronic properties of semiconductor materials to perform a desired function. A semiconductor device may be manufactured as a single discrete device or as one or more ICs packaged into a module.

Configuration—Describes a set up of an element, a circuit, a package, an electronic device, and similar other, and refers to a process for setting, defining, or selecting particular properties, parameters, or attributes of the device prior to its use or operation. Some configuration attributes may be selected to have a default value. For example, a particular value of a feedback gain may be configured by selecting each one of the two external resistors of a feedback circuit.

Accuracy—The degree of conformity of a measured, calculated, or derived value to its actual, nominal, standard, absolute, or a reference value. For example, for a 0-500 millivolts measuring instrument having a 1% accuracy, a voltage measurement is accurate to within 5 millivolts.

An improved, accurate linear voltage regulator having an output voltage that is constant and substantially independent of a cathode current is described with reference to FIGS. 1, 2, and 3.

FIG. 1 illustrates a block diagram of a linear voltage regulator (LVR) 100, according to an embodiment. The LVR 100 includes an adjustable shunt regulator (ASR) 110, a feedback circuit 120, and a compensation circuit 130. In a particular embodiment, the ASR 110 is a commercially available integrated circuit chip such as the Texas Instruments low-voltage adjustable precision shunt regulator TLV1431 or TLV431A. In the depicted embodiment, the ASR 110 is a 4-terminal device that includes terminals or nodes for a cathode 112, a reference 114, an anode sense 116, and an anode power 118. The LVR 100 receives an input voltage Vin 102 from a source such as a battery or similar other direct current (DC) source and provides an output voltage Vout 106 measurable at the cathode 112. In an embodiment, voltages Vin 102 and Vout 106 are measured relative to a voltage reference Vgnd 108 such as ground. In an embodiment, resistor Rin 104 is the internal resistance of the source. In an exemplary embodiment, the LVR 100 provides Vout 106 to a load 190 coupled between the cathode 112 and Vgnd 108, the load 190 drawing a load current load 192. The LVR 100 dynamically adjusts a current flowing through a shunt path, e.g., via the ASR 110, to maintain a substantially constant value of Vout 106 that is independent of the value of the load current Iload 192.

The feedback circuit 120 provides a feedback signal to the ASR 110, the feedback signal being a measure of the Vout 106. In the depicted embodiment, the feedback circuit 120 includes resistor (A−1)R 122 and resistor R 124 coupled in series, their common junction forming the reference 114 node. 'A' is a feedback gain constant and R is a resistance of the feedback circuit 120. The particular values for A and R are configurable and may depend on each application. In a particular embodiment, the value of A may be configured from 1 to 12, and R may be configured from 1 kilo ohms to 100 kilo ohms. Resistance (A−1)R 122 is coupled between the cathode 112 and the reference 114, and resistance R 124 is coupled between the reference 114 and the anode power 118. Total current received by the LVR 100 is a sum of a cathode current (also referred to as an input current to the ASR) Ii 182 flowing through the cathode 112 node and a feedback current Ij 184 flowing through the feedback circuit 120. The load current Iload 192 may be added to the total current depending on a presence or absence of the load 190. A feedback voltage reference Vref 126 is generated at the reference 114 node, the Vref 126 being in proportion to the output voltage 106. In the depicted embodiment, Vout 106 is derived as:

$$\text{Vout}=\text{Vref}*(1+((A-1)*R/R)) \qquad \text{Equation 100}$$

After simplification, Vout 106 is:

$$\text{Vout}=\text{Vref}*A \qquad \text{Equation 102}$$

As described earlier, without the compensation circuit 130, the limited gain of an ASR results in the ASR having a finite output impedance, e.g., 0.2 ohms tested over a particular value range of a cathode current. The limited gain of the ASR is typically measured in amperes per volt (e.g., conductance measured in siemens), and is the reciprocal of the output impedance. The output impedance Zka is defined as a ratio of a change in output voltage divided by a corresponding change in cathode current. This change is measured in volts per amperes and is equal to Zka measured in ohms. The finite output impedance causes an output voltage of the ASR to change with the change in the cathode current. The compensation circuit 130 advantageously compensates for the limited gain of the ASR 110 by adjusting feedback, e.g., by adjusting Vref 126, to reduce output voltage Vout 106 with an increase in the cathode current Ii 182. An amount of the feedback is adjusted so that an increase in the Vout 106 due to an increase in the Ii 182 is effectively canceled by an increase in the Vref 126 and reduction in Vout 106 generated by the compensation circuit 130. Additional details of configuring the compensation circuit 130 to achieve the output voltage Vout 106 that is substantially independent of the cathode current Ii 182 is described with reference to Equations 104, 106, 108, and 110 and with reference to FIG. 2.

The compensation circuit 130 includes a compensation resistor C 132 and an optional compensation resistor X 134 coupled in series between the anode power 118 and Vgnd 108, the resistor C 132 and the resistor X 134 forming a node coupled to the anode sense 116. In a particular embodiment, the value of the optional compensation resistor X 134 is zero ohms, thereby coupling the anode sense 116 node to Vgnd 108. Disposing the compensation circuit 130 between the anode power 118 and the Vgnd 108 effectively introduces a voltage bias and increases the voltage measured at the anode power 118 relative to Vgnd 108. If the resistor X 134 is zero, a compensating voltage Vcomp 186 measured at the anode power 118 is (Ii 182+Ij 184)*C 132. If the resistor X 134 is not configured to zero ohms but has a finite value, the value of Vcomp 186 is increased further by (Ii 182+Ij 184)*X 134. The compensating voltage Vcomp 186 or a portion thereof, which is proportional to the cathode current Ii 182, is advantageously added to the feedback voltage reference Vref 126 to compensate for the limited gain of the ASR 110. The compensating voltage Vcomp 186 compensates for the limited gain by reducing a differential voltage Vdiff 128 measurable across inputs to the ASR 110, e.g., across Vref 126 and the anode sense 116. The anode sense 116 is coupled to an internal voltage reference Viref 136, e.g., 2.5 volts DC, which remains constant.

In the depicted embodiment, the ASR 110 includes a comparator 170, having a positive and negative differential input respectively coupled to the reference 114 and anode sense 116 nodes, and an error voltage 172 as an output. In a particular embodiment, the comparator 170 is implemented as an operation amplifier. The error voltage 172 controls the operation of a transistor T 174. The transistor T 174 is coupled to the cathode 112, the anode power 118, and a base coupled to the output of the comparator 170. Thus, differential voltage Vdiff 128 between Vref 126 and the anode sense 116 generates the error voltage 172, which controls the flow of the cathode current Ii 182.

The differential voltage Vdiff 128 is expressed in terms of a change in the cathode current Ii 182 and output impedance as follows:

Zka=change in voltage/change in current (per definition of output impedance) Vdiff=Zka'*$i$ Equation 104 where Zka' is the output impedance of the ASR 110, and i is the change in the cathode current Ii 182.

The value of resistor C 132 configured to compensate or cancel the effects of the limited gain of the ASR 110 (and hence the finite output impedance of the ASR) is derived as follows:

i=change in cathode current, j=change in feedback current Ij 184, vref=change in Vdiff 128, v=change in Vout 106, and Zka'=vref/i Change in feedback current j is based on a change in voltage across resistors C 132 and X 134 is (since A*R>>Zka' and i>>j, only i is considered):

$$j=[-iX-iC]/[R+(A-1)R] \quad \text{Equation 106}$$

After simplification j=[−iX−iC]/R.

To achieve an output voltage that is independent of the change in the cathode current, Vout 106 is set to be equal to zero, That is, the unavoidable Vdiff 128 voltage change plus voltage change across optional resistor 134 from current Ii 182 is supplied from the compensation resistor 132 instead of Vout 106. Value of the resistor C 132 is derived as follows (where i>>j and Vdiff=Zka'*i):

$$iX+iC+jR=iX+Zka'*i \quad \text{Equation 108}$$

Substituting value of j from Equation 106, $$iX+[(-iX-iC)/AR]*R=Zka'*i$$

After simplification, $$C=[A*Zka'+X]/[A-1] \quad \text{Equation 110}$$

The value of the resistor C 132 is positive since the feedback gain A is >1, and Zka' and X have positive values. Therefore, by properly configuring a value of the resistor C 132 per Equation 110, all linear effects caused by the limited gain of the ASR 110 are cancellable. The value of the optional compensation resistor X 134 may be increased to lessen the effects of variances in output impedance Zka' between one ASR to another. The value of the resistor C 132 computed per Equation 110 may change slightly if effects of j and changes in currents flowing to differential input of the ASR 110 are considered in a more rigorous computation. Therefore, for the ASR 110 having a limited gain, a particular value of C 132 is configurable to cancel or compensate all first order effects of the change in cathode current Ii 182.

Figure 2:
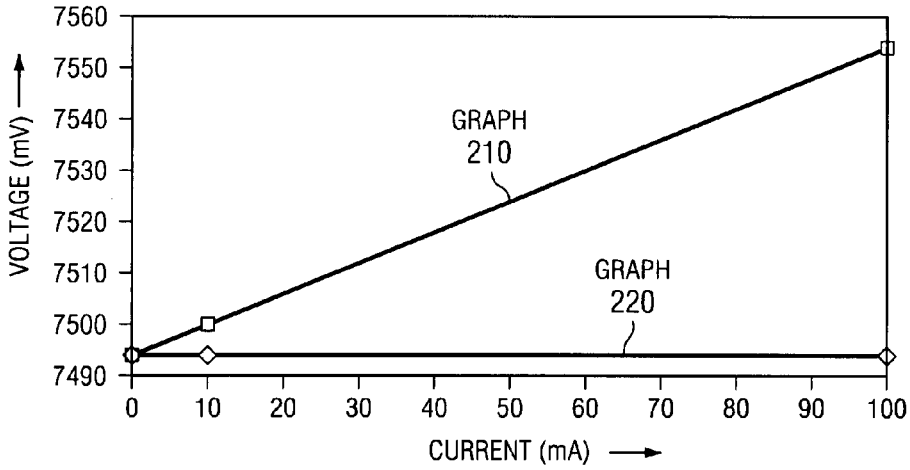
FIG. 2 illustrates a graphical relationship between output voltages corresponding to various cathode currents for a linear voltage regulator described with reference to FIG. 1 and a traditional ASR, according to an embodiment.

FIG. 2 illustrates a graphical relationship between output voltages corresponding to various cathode currents for the linear voltage regulator 100 described with reference to FIG. 1 and a traditional ASR, according to an embodiment. Referring to FIGS. 1 and 2, graph 210 illustrates a linear relationship between change in output voltage (Y axis, ranging from 7490 millivolts (minimum value) to 7560 millivolts (maximum value) and change in cathode current (X axis, ranging from 0 milliamperes (minimum value) to 100 milliamperes (maximum value) for the traditional ASR. A slope of the graph 210 is equal to Zka', the output impedance stated in the product specification sheet as 0.2 ohms. At the rated cathode current of 10 milliamperes the output voltage is 7.5 volts (A=3)*(Vref=2.5). As the cathode current changes, there is a corresponding change in the output voltage. Thus, the accuracy of the output voltage deteriorates rapidly as the cathode current deviates from the rated value of 10 milliamperes.

Graph 220 illustrates an independent relationship between the output voltage Vout 106 and the cathode current Ii 182 of the LVR 100. The LVR 100 is configured with the following values: feedback gain A=3, Viref 136=Vref 126=2.5 volts, Zka'=0.2 ohms rated at 10 milliamperes, X 134=zero ohms, and per Equation 110 C 132=0.3 ohms. The compensation voltage Vcomp 186 generated across the resistor C 132 at 0, 10, and 100 milliamperes is respectively 0, 3, and 30 millivolts. The compensation voltage Vcomp 186 is advantageously added to the Vref 126 to compensate for the effects of the limited gain of the ASR 110. After compensation, the value of Vout 106 corresponding to 0, 10, and 100 milliamperes is respectively 7494, 7494.1, and 7494 millivolts. That is, the Vout 106 (equal to Vref*A) is substantially constant and does not change with a change in the cathode current Ii 182. Various types of testing (e.g., empirical, using simulation tools, and similar others) of the LVR 100 verify that the change in the output voltage Vout 106 corresponding to a change in the cathode current Ii 182 from 1 to 100 milliamperes (i=99 milliamperes) is just 1 millivolt across the operating span. Thus, through compensation, the effective Zka is reduced to 10 milliohms. As described earlier, the independent relationship is advantageously established due to the compensation effect provided by the compensation circuit 130. The accuracy of the output voltage is substantially unchanged over the entire operating range of the cathode current.

In an embodiment, the resistors C 132 and X 134 included in the compensation circuit 130 may be fabricated as trace resistors and integrated into the IC chip of the ASR 110, the LVR 100, or both. Use of trace resistors for fabricating the resistors C 132 and X 134 advantageously lowers the cost compared to feeding the shunt with a regulated current source. For example, a four wire ASR with the compensation circuit fabricated with bond wires may advantageously use smaller diameter gold bond wires compared to a prior art ASR, thereby reducing assembly costs.

Figure 3:
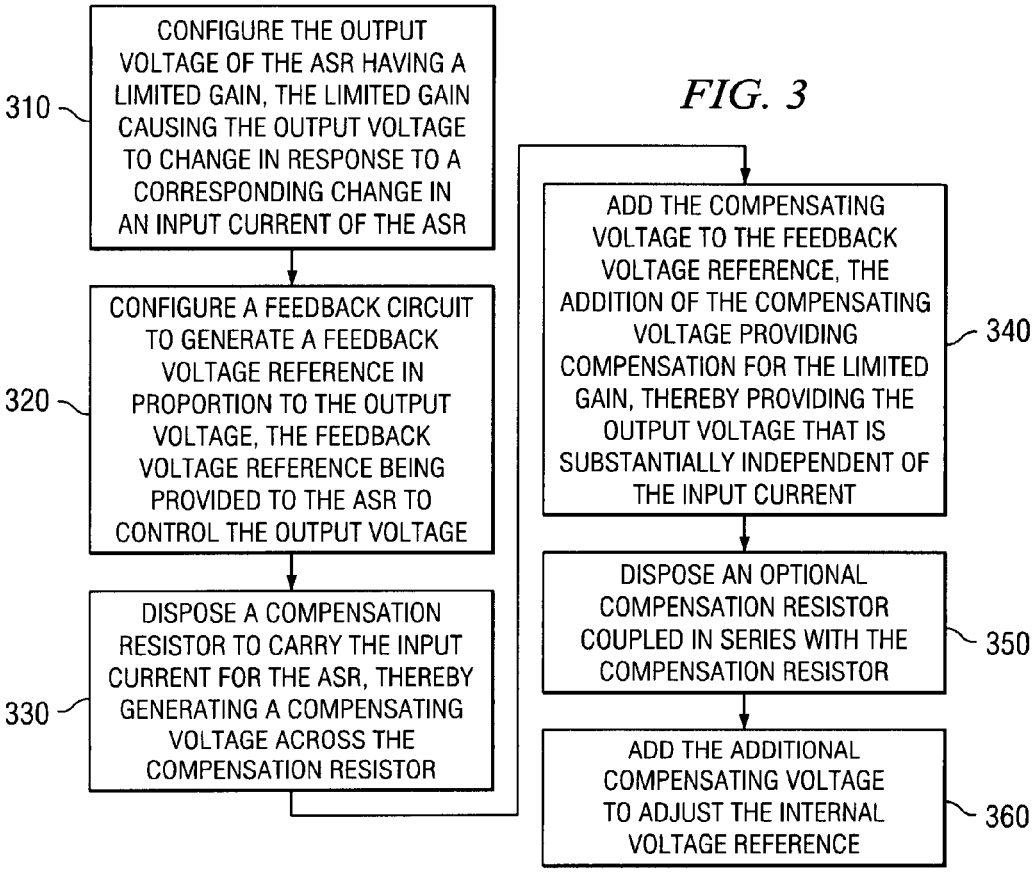
FIG. 3 is a flow chart illustrating a method for regulating an output voltage of an adjustable shunt regulator (ASR), according to an embodiment.

FIG. 3 is a flow chart illustrating a method for regulating an output voltage of an adjustable shunt regulator (ASR), according to an embodiment. In a particular embodiment, the method is used to regulate the output voltage of the LVR 100 that includes the ASR 110 described with reference to FIGS. 1, and 2. At step 310, the output voltage of the ASR having a limited gain is configured, the limited gain causing the output voltage to change in response to a corresponding change in an input current of the ASR. The configuration may include selection of a desired voltage value of the Vout. At step 320, a feedback circuit is configured to generate a feedback voltage reference in proportion to the output voltage, the feedback voltage reference being provided to the ASR to control the output voltage. The configuration of the feedback circuit may include configuration of resistor R and selection of the feedback gain value based on the internal voltage reference Viref. At step 330, a compensation resistor is disposed to carry the cathode current (also referred to as the input current for the ASR), thereby generating a compensating voltage across the compensation resistor. At step 340, the compensating voltage is added to the feedback voltage reference, the addition of the compensating voltage providing compensation for the limited gain, thereby providing the output voltage that is substantially independent of the input current.

Various steps described above may be added, omitted, combined, altered, or performed in different orders. For example, steps 350 and 360 may be added. At step 350, an optional compensation resistor is disposed to be coupled in series with the compensation resistor. The optional compensation resistor provides an additional compensating voltage. At step 360, the additional compensating voltage is added to adjust the internal voltage reference.

Several advantages are achieved by the method and system according to the illustrative embodiments presented herein. The embodiments advantageously provide for an accurate, linear voltage regulator (LVR) that provides an output voltage that is substantially independent of the cathode current. The LVR is based on a commercially available adjustable shunt regulator (ASR). The accuracy of the output voltage of the LVR is maintained throughout the operating range of the cathode current. A compensation resistor is advantageously added to carry the cathode current, thereby generating a compensating voltage. The compensating voltage is added to the feedback circuit of the ASR to compensate for the limited gain. With the compensating voltage, the effective Zka of the ASR is advantageously reduced by a factor of at least 10, thereby providing an output voltage that is substantially independent of the cathode current. The compensation resistor is easily fabricated as a metal trace and integrated with the ASR.

Although illustrative embodiments have been shown and described, a wide range of modification, change and substitution is contemplated in the foregoing disclosure and in some instances, some features of the embodiments may be employed without a corresponding use of other features. Those of ordinary skill in the art will appreciate that the hardware and methods illustrated herein may vary depending on the implementation. For example, while certain aspects of the present disclosure have been described in the context of using discrete components such as resistors, those of ordinary skill in the art will appreciate that the apparatus and methods disclosed herein are capable of being implemented as integrated circuit chips. As another example, the ASR with the compensation circuit may be implemented as a semiconductor device or the LVR which includes the ASR and the compensation circuit may be implemented as a semiconductor device.

The methods and systems described herein provide for an adaptable implementation. Although certain embodiments have been described using specific examples, it will be apparent to those skilled in the art that the invention is not limited to these few examples. The benefits, advantages, solutions to problems, and any element(s) that may cause any benefit, advantage, or solution to occur or become more pronounced are not to be construed as a critical, required, or an essential feature or element of the present disclosure.

The above disclosed subject matter is to be considered illustrative, and not restrictive, and the appended claims are intended to cover all such modifications, enhancements, and other embodiments, which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A linear voltage regulator (LVR) comprising:

an adjustable shunt regulator (ASR) having a limited gain, the limited gain causing an output voltage of the ASR to change in response to a change in an input current of the ASR;

a feedback circuit to generate a feedback voltage reference in proportion to the output voltage, the feedback voltage reference being provided to the ASR to control the output voltage; and a compensation resistor coupled to the ASR and the feedback circuit, wherein the input current flows through the compensation resistor to provide a compensating voltage across the compensation resistor, the compensating voltage being provided to the feedback circuit, wherein the compensating voltage compensates the limited gain to provide the output voltage that is substantially independent of the input current.

2. The LVR of claim 1, wherein a feedback gain of the feedback circuit is configurable to adjust the output voltage with reference to an internal voltage reference provided to the ASR.

3. The LVR of claim 2, wherein the limited gain is between 1 and 10,000 siemens, wherein the feedback gain is configurable between 1 and 25.

4. The LVR of claim 2, wherein the output voltage is the feedback voltage reference multiplied by the feedback gain.

5. The LVR of claim 2 further comprising:

an optional compensation resistor coupled in series with the compensation resistor, wherein the optional compensation resistor provides an additional compensating voltage to adjust the internal voltage reference in response to the change in the input current.

6. The LVR of claim 5, wherein the optional compensation resistor is zero ohms.

7. The LVR of claim 5, wherein the optional compensation resistor is configurable to further adjust the compensating voltage in response to the change in the input current.

8. The LVR of claim 5, wherein the compensation resistor is configured to have a value equal to a numerator divided by a denominator, wherein the numerator includes a first term added to a second term, wherein the first term is the feedback gain multiplied by the output impedance and the second term is the optional compensation resistor, wherein the denominator is the feedback gain minus one.

9. The LVR of claim 1, wherein the ASR includes:

a comparator coupled to the feedback circuit to compare the feedback voltage reference to an internal voltage reference and provide an error voltage; and a pass element coupled to the comparator to receive the error voltage, wherein the error voltage controls the pass element, wherein the pass element controls a flow of the input current.

10. The LVR system of claim 9, wherein the compensating voltage is added to the feedback voltage reference to compensate for the limited gain, wherein the compensating voltage reduces the error voltage in proportion to the change in the input current.

11. The LVR of claim 9, wherein the error voltage is an output impedance of the ASR multiplied by the input current, wherein the output impedance of the ASR is a ratio of a change in the feedback voltage reference to a corresponding change in the input current.

12. A method for regulating an output voltage of an adjustable shunt regulator (ASR), the method comprising:

configuring the output voltage of the ASR having a limited gain, the limited gain causing the output voltage to change in response to a corresponding change in an input current of the ASR;

configuring a feedback circuit to generate a feedback voltage reference in proportion to the output voltage, the feedback voltage reference being provided to the ASR to control the output voltage;

disposing a compensation resistor to carry the input current, thereby generating a compensating voltage across the compensation resistor; and adding the compensating voltage to the feedback voltage reference, the addition of the compensating voltage providing compensation for the limited gain, thereby providing the output voltage that is substantially independent of the input current.

13. The method of claim 12 wherein the configuration of the feedback circuit includes:

configuring a feedback gain of the feedback circuit to adjust the output voltage in proportion to an internal voltage reference provided to the ASR.

14. The method of claim 13, wherein the output voltage is the feedback voltage reference multiplied by the feedback gain.

15. The method of claim 12 further comprising:

disposing an optional compensation resistor coupled in series with the compensation resistor, wherein the optional compensation resistor provides an additional compensating voltage; and adding the additional compensating voltage to adjust the internal voltage reference.

16. The method of claim 15, wherein the optional compensation resistor is configured to have a value of zero ohms.

17. The method of claim 15, wherein the optional compensation resistor is configurable to further adjust the compensating voltage in response to the change in the input current.

18. The method of claim 15, wherein the compensation resistor is configured to have a value equal to a numerator divided by a denominator, wherein the numerator includes a first term added to a second term, wherein the first term is the feedback gain multiplied by the output impedance and the second term is the optional compensation resistor, wherein the denominator is the feedback gain minus one.

19. The method of claim 12, wherein providing the compensation for the limited gain includes:

comparing the addition of the compensating voltage and the feedback voltage reference to an internal voltage reference, the comparison providing an error voltage;

controlling the input current in response to the error voltage by adjusting the compensating voltage.

20. The method of claim 19, wherein the error voltage is an output impedance of the ASR multiplied by the input current, wherein the output impedance of the ASR is a ratio of a change in the feedback voltage reference to a corresponding change in the input current.

* * * * *